US010462580B2

(12) United States Patent
Dehe et al.

(10) Patent No.: US 10,462,580 B2
(45) Date of Patent: Oct. 29, 2019

(54) MICROELECTROMECHANICAL LOUDSPEAKER

(71) Applicant: Infineon Technologies AG, Neubiberg (DE)

(72) Inventors: Alfons Dehe, Villingen-Schwenningen (DE); Yauheni Belahurau, Vienna (AT); Manuel Dorfmeister, Vienna (AT); Christoph Glacer, Munich (DE); Manfred Kaltenbacher, Vienna (AT); Ulrich Schmid, Vienna (AT); Michael Schneider, Vienna (AT); David Tumpold, Kirchheim b Munich (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/928,821

(22) Filed: Mar. 22, 2018

(65) Prior Publication Data

US 2018/0279055 A1 Sep. 27, 2018

(30) Foreign Application Priority Data

Mar. 23, 2017 (DE) ..... 10 2017 106 256

(51) Int. Cl.

| | |
|---|---|
| ***H04R 19/02*** | (2006.01) |
| ***H04R 1/00*** | (2006.01) |
| *H04R 17/00* | (2006.01) |

(52) U.S. Cl.

CPC ..... *H04R 19/02* (2013.01); *H04R 1/005* (2013.01); *H04R 17/00* (2013.01); *H04R 2201/003* (2013.01)

(58) Field of Classification Search

CPC ..... H04R 1/005; H04R 17/00; H04R 19/02; H04R 2201/003

USPC ..... 381/111

See application file for complete search history.

(56) References Cited

U.S. PATENT DOCUMENTS

| | | | | |
|---|---|---|---|---|
| 9,402,137 | B2 * | 7/2016 | Hsu | H04R 19/005 |
| 2013/0121509 | A1 | 5/2013 | Hsu et al. | |

FOREIGN PATENT DOCUMENTS

| | | | |
|---|---|---|---|
| WO | 2016162829 | A1 | 10/2016 |

* cited by examiner

*Primary Examiner* — Paul Kim

(74) *Attorney, Agent, or Firm* — Slater Matsil, LLP

(57) ABSTRACT

A microelectromechanical loudspeaker may include: a plurality of elementary loudspeakers each including a drive unit and a diaphragm deflectable by the drive unit, and a controller configured to respectively supply control signals to the drive units. The drive units may be respectively configured to deflect the corresponding diaphragms according to the respective control signals supplied by the controller to generate acoustic waves. The control signal supplied to at least one control unit may have at least one local extremum and a global extremum of a curvature of the control signal with a highest absolute value of the curvature may be located at a position of the control signal preceding a position of the at least one local extremum of the control signal.

21 Claims, 17 Drawing Sheets

| | Basic configuration | | Additional-speaklet configuration | | Overlapping-frames configuration |
|---|---|---|---|---|---|
| | 3 Bit Groups | 4 Bit Groups | 3 Bit Groups | 4 Bit Groups | 4 Bit Groups |
| Ratio R | 11.2 | 23.1 | 13.4 | 25.1 | 8.5 |
| THD, % | 36 | 29 | 23 | 21 | 12 |

FIG. 16

MICROELECTROMECHANICAL LOUDSPEAKER

This application claims the benefit of German Application No. 102017106256.4, filed on Mar. 23, 2017, which application is hereby incorporated herein by reference in its entirety.

TECHNICAL FIELD

Various embodiments relate generally to a microelectromechanical loudspeaker.

BACKGROUND

Microelectromechanical loudspeakers configured to digitally reconstruct acoustic waves have become the subject of intense research in the past few years, since they offer the possibility of directly transforming digital information encoding sound into sound. The sound pressure currently achievable by conventional microelectromechanical loudspeakers of this kind from digital signals is, however, poor.

Therefore, a need exists for a microelectromechanical loudspeaker configured to digitally reconstruct acoustic waves in a highly efficient manner.

SUMMARY

According to various embodiments, a microelectromechanical loudspeaker is provided. The microelectromechanical loudspeaker may include: a plurality of elementary loudspeakers each comprising a drive unit and a diaphragm deflectable by the drive unit, and a controller configured to respectively supply control signals to the drive units. The drive units may be respectively configured to deflect the corresponding diaphragms according to the respective control signals supplied by the controller to generate acoustic waves. A control signal supplied to at least one drive unit may have at least one local extremum and a global extremum of a curvature of the control signal with a highest absolute value of the curvature may be located at a position of the control signal preceding a position of the at least one local extremum of the control signal.

BRIEF DESCRIPTION OF THE DRAWINGS

In the drawings, like reference characters generally refer to the same pails throughout the different views. The drawings are not necessarily to scale, emphasis instead generally being placed upon illustrating the principles of the disclosure. In the following description, various embodiments are described with reference to the following drawings, in which:

FIG. 16 is a table summarizing the main characteristics of differently configured microelectromechanical loudspeakers operated in different ways;

DETAILED DESCRIPTION OF ILLUSTRATIVE EMBODIMENTS

The following detailed description refers to the accompanying drawings that show, by way of illustration, specific details and embodiments of the present disclosure.

The word "exemplary" is used herein to mean "serving as an example, instance, or illustration". Any embodiment or design described herein as "exemplary" is not necessarily to be construed as preferred or advantageous over other embodiments or designs.

Figure 1:
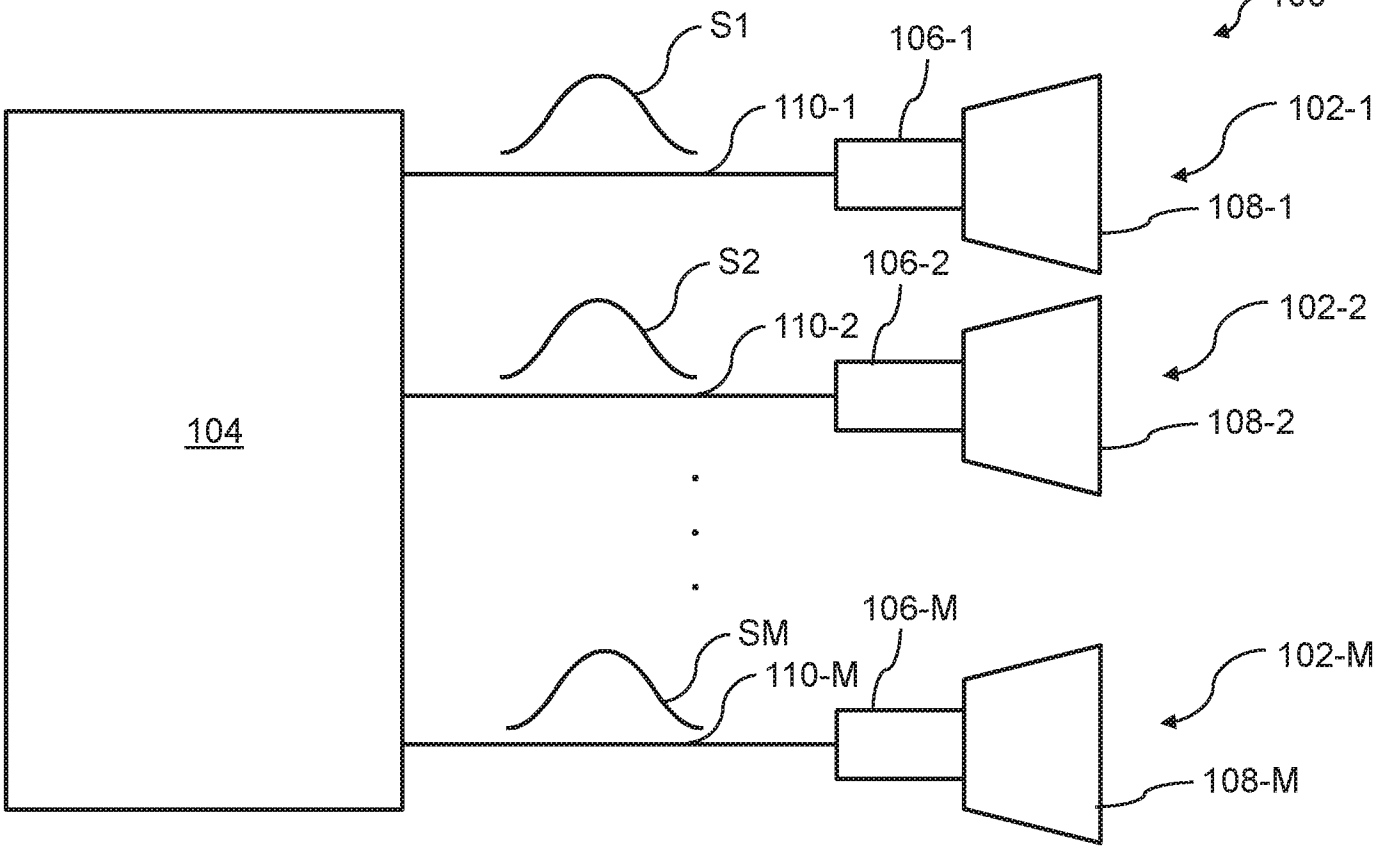
FIG. 1 is a schematic view of an exemplary microelectromechanical loudspeaker including a plurality of speaklets.

FIG. 1 is a schematic view of a microelectromechanical loudspeaker 100. The microelectromechanical loudspeaker 100 may include a plurality of elementary loudspeakers 102-1, 102-2, . . . , 102-M and a controller 104. The elementary loudspeakers 102-1, 102-2, . . . , 102-M are hereinbelow generally referred to as speaklets. Each of the speaklets 102-1, 102-2, . . . , 102-M may include respective drive units 106-1, 106-2, . . . , 106-M and respective diaphragms 108-1, 108-2, . . . , 108-M deflectable by a respective drive unit 106-1, 106-2, . . . , 106-M.

The controller 104 may be configured to supply control signals S1, S2, . . . , SM to the respective drive units 106-1, 106-2, . . . , 106-M, e.g., via respective control lines 110-1, 110-2, . . . , 110-M. The drive units 106-1,106-2, . . . , 106-M may be configured to deflect the corresponding diaphragms 108-1,108-2, . . . , 108-M according to the control signals S1, S2, . . . , SM supplied by the controller 104 to thereby generate acoustic waves.

At least one drive unit 106-1, 106-2, . . . , 106-M, a plurality of drive units 106-1,106-2, . . . , 106-M, or even all drive units 106-1,106-2, . . . , 106-M, may be configured to apply an electric driving voltage or driving current to a corresponding diaphragm 108-1, 108-2, . . . , 108-M, e.g. to generate an electrostatic force, according to the respective control signals S1, S2, . . . , SM supplied from the controller 104 to deflect the respective diaphragms 108-1, 108-2, . . . , 108-M. Alternatively or additionally, at least one drive unit 106-1, 106-2, . . . , 106-M, a plurality of drive units 106-1, 106-2, . . . , 106-M, or even all drive units 106-1, 106-2, . . . , 106-M, may include a respective piezoelectric element and the corresponding drive unit 106-1, 106-2, . . . , 106-M may be configured to apply an electric voltage and/or current according to a control signal S1, S2, . . . , SM supplied by the controller 104 to said piezoelectric element to deflect the diaphragm 108-1, 108-2, . . . , 108-M of the corresponding speaklet 102-1, 102-2, . . . , 102-M according to the respective control signals S1, S2, . . . , SM.

By way of example, the controller 104 may include or may be configured as an application specific integrated circuit (ASIC) and/or a microcontroller and/or a field programmable gate array (FPGA) and/or a programmable system on chip (pSoC). For those who are skilled in the art of controlling, the controller 104 can be any suitable control unit similar to the previously-mentioned ones.

The speaklets 102-1, 102-2, . . . , 102-M of the microelectromechanical loudspeaker 100 according to the present disclosure may be controlled by the controller 104 so as to generate acoustic waves (sound) by the superposition of sound pulses generated by the individual speaklets 102-1, 102-2, . . . , 102-M. This approach is generally referred to as Digital Sound Reconstruction (DSR).

In the following, the characteristics of acoustic waves generated by a vibrating diaphragm 108-1, 108-2, . . . , 108-M will be briefly described.

In general, the sound pressure pa generated by a vibrating diaphragm 108-1, 108-2, . . . , 108-M at a distance R therefrom is given by the following expression:

$$p_a(R, t) \approx \rho_o/(4\pi R)\cdot\partial^2 u/\partial t^2\cdot\Gamma \quad (1)$$

In expression (1), $\rho_o$ is the mean density of a fluid such as of air surrounding the diaphragm 108-1, 108-2, . . . , 108-M, R is a distance from a diaphragm 108-1, 108-2, . . . , 108-M, u is a deflection of the diaphragm 108-1, 108-2, . . . , 108-M, t is the time, $\partial^2 u/\partial t^2$ is an acceleration of the diaphragm 108-1, 108-2, . . . , 108-M, and $\Gamma$ is the area of the diaphragm 108-1, 108-2, . . . , 108-M. As indicated by the above expression (1), the acoustic pressure pa generated by a vibrating diaphragm 108-1, 108-2, . . . , 108-M is approximately proportional to the acceleration of the diaphragm 108-1, 108-2, . . . , 108-M.

Figure 2:
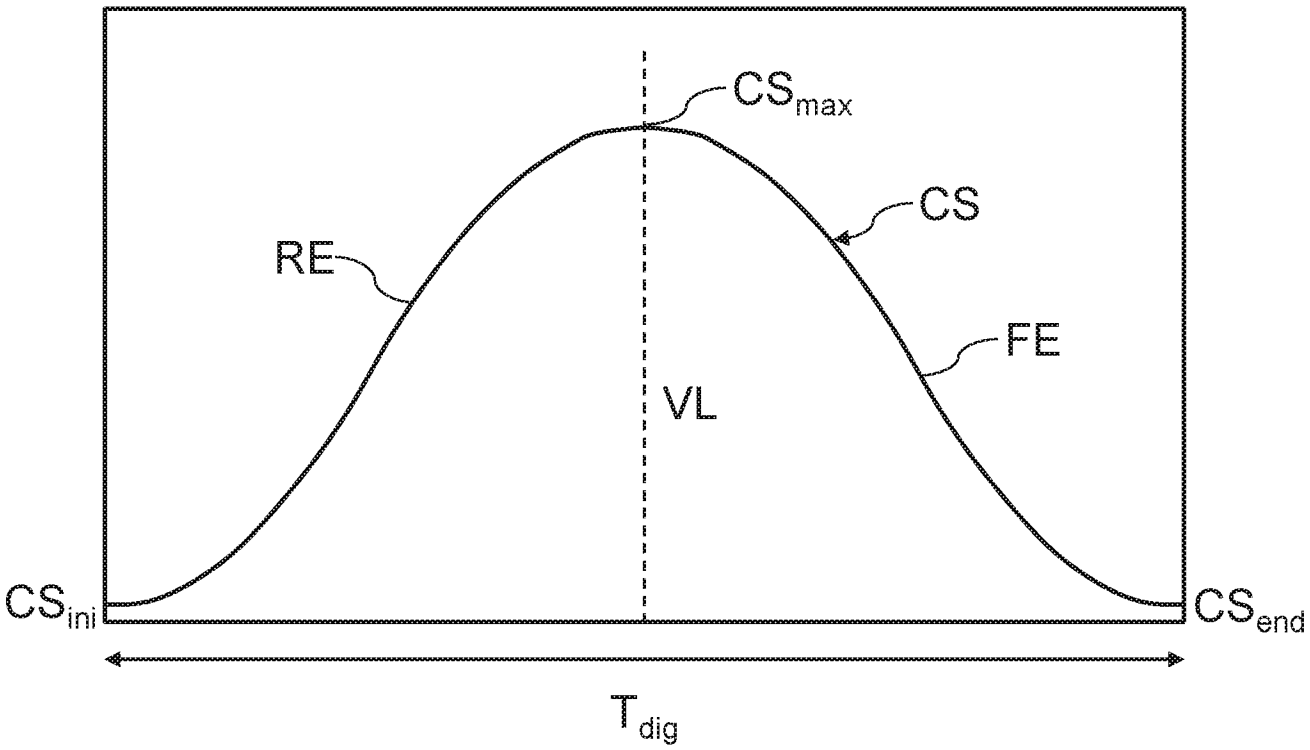
FIG. 2 shows a conventional control signal for controlling a speaklet.

The control signals supplied by a controller in a conventional microelectromechanical loudspeaker are usually bell shaped, as indicated in FIG. 2. As shown in FIG. 2, such a conventional bell-shaped control signal CS has a single local maximum $CS_{max}$ and is substantially symmetrical with respect to a vertical line VL intersecting the maximum $CS_{max}$ of the control signal CS. The control signal CS depicted in FIG. 2 has a rising edge RE between an initial value $CS_{ini}$ and the maximum $CS_{max}$, and a falling edge FE between the maximum $CS_{max}$ and an end value $CS_{end}$ of the control signal CS. The duration of the control signal CS corresponds to the time period between the initial value $CS_{ini}$ and the end value $CS_{end}$ of the control signal CS, and is referred to as digital time $T_{dig}$.

Figure 3:
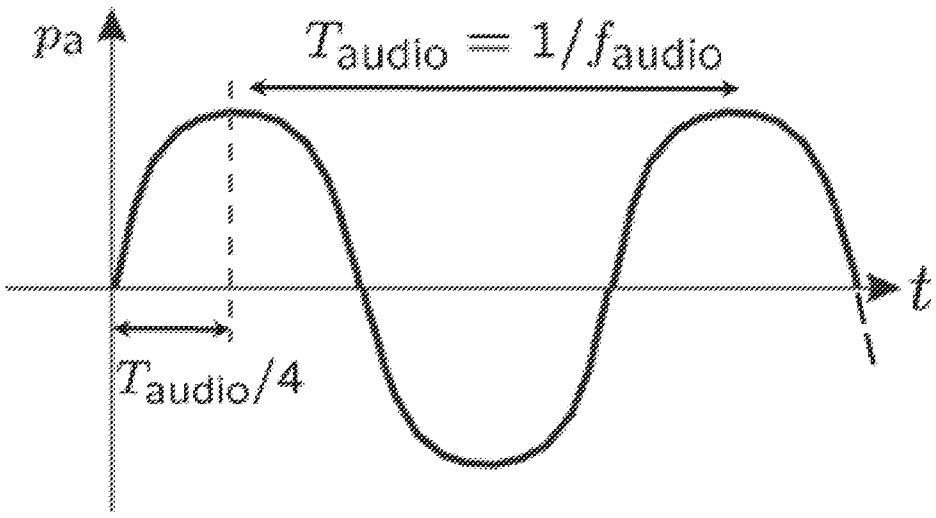
FIG. 3 shows an exemplary periodic acoustic wave to be digitally reconstructed.

The digital time $T_{dig}$ may be set depending on the characteristics of the sound wave that is to be reconstructed by digital sound reconstruction as well as the number M of speaklets. In FIG. 3, the variation of the sound pressure (acoustic pressure) pa with time of an exemplary acoustic wave is shown. The exemplary acoustic wave shown in FIG. 3 is periodic, i.e. mono-frequent. As such it is characterized inter alia by its period $T_{audio}$ or by its frequency $f_{audio}$ which is the inverse value of the period $T_{audio}$, i.e. $T_{audio}=1/f_{audio}$.

Figure 4:
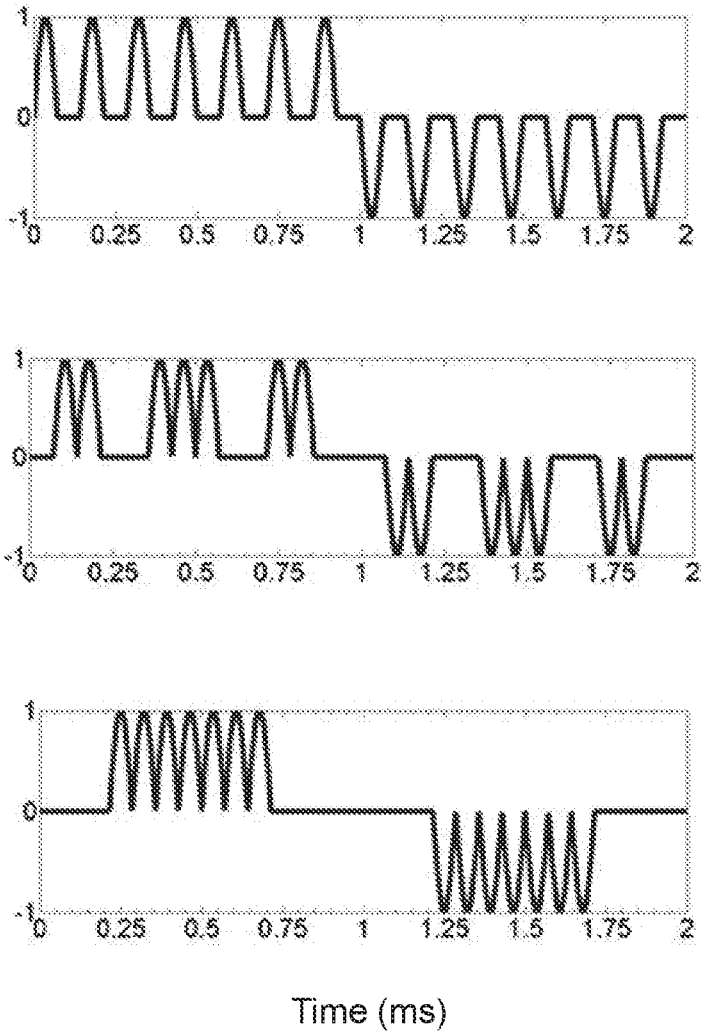
FIG. 4 shows a scheme of superimposing a plurality of sound pulses generated by a plurality of speaklets for reconstructing the acoustic wave shown in FIG. 3.

By applying the control signal CS shown in FIG. 2 to the speaklets of a microelectromechanical loudspeaker in a predetermined manner, the sound wave shown in FIG. 3 can be digitally reconstructed. This is exemplarily shown in FIG. 4. The three diagrams of FIG. 4 show individual pulse trains composed of a plurality of the control signals shown in FIG. 2 as well as of a plurality of negative pulses formed therefrom that are applied to respective predetermined numbers of speaklets of a microelectromechanical loudspeaker. In an exemplary microelectromechanical loudspeaker, the pulse train in the upper diagram may be applied to a first predetermined number of speaklets, the pulse train in the middle diagram may be applied to a second predetermined number of speaklets, and the pulse train in the bottom diagram of FIG. 4 may be applied to a third predetermined number of speaklets. Each of the speaklets to which the respective pulse trains are applied generates sound pulses. By a superposition of the sound pulses generated by the individual speaklets, the acoustic wave shown in FIG. 3 can be generated, i.e. digitally reconstructed.

As shown in FIG. 4, the sound wave to be digitally reconstructed has a frequency $f_{audio}$ of about 500 Hz.

Since in digital sound reconstruction a predetermined acoustic wave is generated by a superposition of a plurality of individual sound pulses generated by individual speaklets, an efficient generation of sound pulses by the individual speaklets is required, i.e. the generation of sound pulses with a high sound pressure, for an efficient digital sound reconstruction.

The sound pressure that may be generated by a given speaklet depends in particular on the detailed configuration of a control signal that governs the generation of sound pulses by a speaklet that is controlled on the basis thereof. This will be subsequently explained on the basis of the control signal shown in FIG. 2 with reference to FIG. 5.

Figure 5:
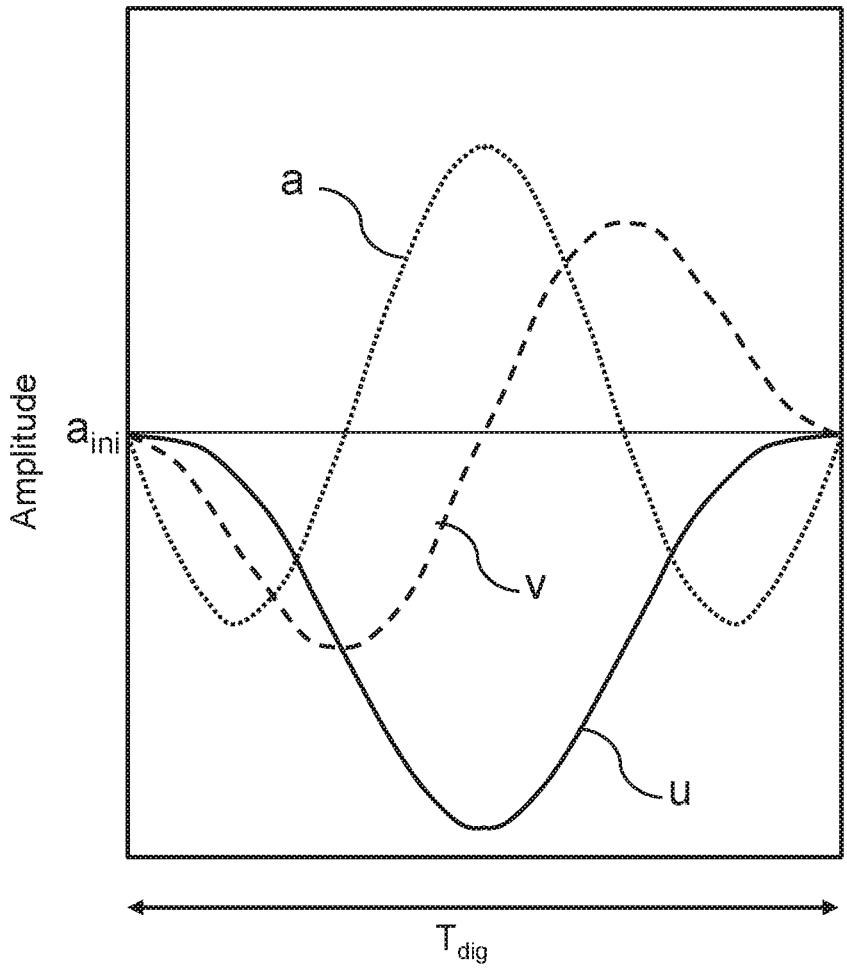
FIG. 5 shows the displacement, the velocity, and the acceleration of a diaphragm oscillating according to the control signal shown in FIG. 2.

FIG. 5 shows the displacement u at the center of a diaphragm controlled by a control signal depicted in FIG. 2. In FIG. 5, the velocity v of the diaphragm at the center thereof as well as the acceleration a of the diaphragm at the center thereof are also shown. As previously mentioned with respect to expression (1), the acoustic pressure $p_a$ generated by a vibrating diaphragm is proportional to the second time derivative of the displacement of the diaphragm, i.e. proportional to its acceleration. Consequently, the acceleration a of the diaphragm is indicative of the sound pressure pa generated by a vibrating diaphragm.

Figure 6:
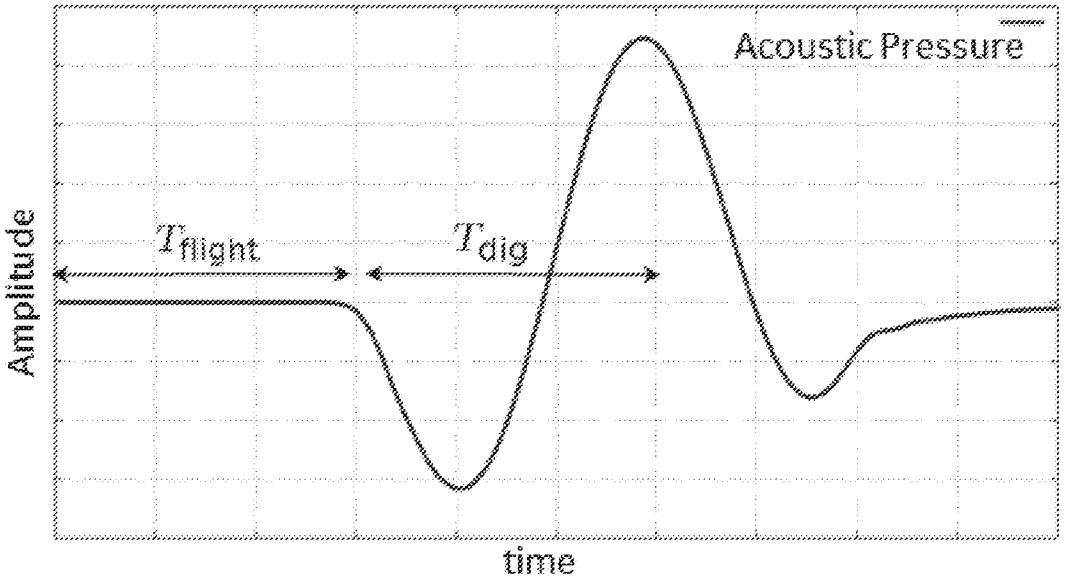
FIG. 6 shows an acoustic pressure pulse generated by a diaphragm oscillating as shown in FIG. 5.

As shown in FIG. 5, the acceleration of the diaphragm has positive and negative amplitudes with respect to an initial value $a_{ini}$ thereof that are also present in the sound pressure, as can clearly be seen in FIG. 6 that shows the amplitude of the corresponding acoustic pressure pa over time. In FIG. 6, $T_{flight}$ denotes the time required for the acoustic waves generated by a vibrating diaphragm to reach a microphone. $T_{dig}$ denotes the above-discussed digital time.

As can clearly be seen in FIG. 6, the acoustic pressure pa generated by the vibrating diaphragm of a speaklet has both positive and negative amplitudes of similar magnitudes leading to an extinction of sound pulses generated by a speaklet when they interfere with sound pulses generated by other speaklets of the microelectromechanical loudspeaker.

Figure 7:
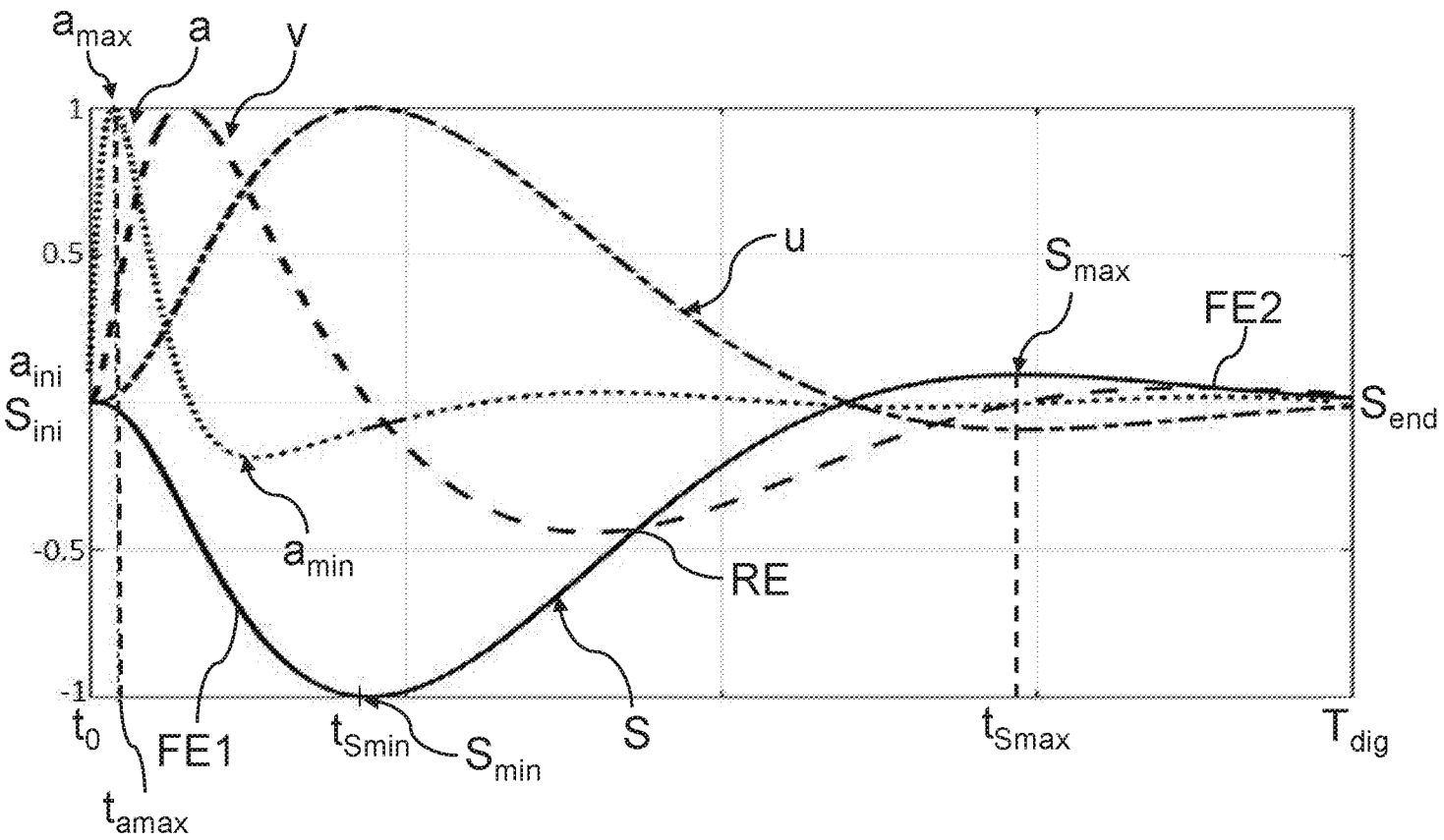
FIG. 7 shows a control signal according to the present disclosure as well as the displacement, the velocity, and the acceleration of a diaphragm oscillating according to this control signal.

These problems may be overcome by a control signal S shown in FIG. 7. The control signal S shown in FIG. 7 has a local minimum $S_{min}$ smaller than an initial value Sini thereof and a local maximum $S_{max}$ larger than the initial Sini of the control signal S.

A global maximum $a_{max}$ of a curvature of the control signal S with a highest absolute value of the curvature is located at a position (timing) $t_{amax}$ of the control signal S preceding a position $t_{Smin}$ of the local minimum $S_{min}$ of the control signal S and a position $t_{Smax}$ of the local maximum $S_{max}$ of the control signal S. The absolute value of the global maximum $a_{max}$ of the curvature may be defined with respect to an initial value $a_{ini}$ of the curvature, i.e. as a difference between $a_{max}$ and $a_{ini}$. The above relation may be expressed by the corresponding timings or positions $t_{amax}$, $t_{Smin}$, and $t_{Smax}$ of the global maximum $a_{max}$ of the curvature of the control signal S, the local minimum $S_{min}$ of the control signal S, and the local maximum $S_{max}$ of the control signal S, respectively:

$$t_{amax}<t_{Smin}<t_{Smax}. \quad (2)$$

As shown in FIG. 7, a such configured control signal S can be provided with an asymmetric shape including a signal portion with a high curvature for the generation of a sound pulse with a high acoustic pressure of a predetermined sign, and a signal portion including the local minimum $S_{min}$ and the local maximum $S_{max}$ for restoring the initial position of the diaphragm in a well-defined way, thereby avoiding signal portions with a high curvature of a sign opposite to the sign of the global maximum $a_{max}$.

In an exemplary embodiment, the local maximum $S_{max}$ and the local minimum $S_{min}$ may be characterized in that the first time derivative of the control signal S vanishes at the respective timings $t_{Smax}$ and $t_{Smin}$ of the local maximum $S_{max}$ and the local minimum $S_{min}$, respectively.

In FIG. 7, the displacement u at a center of a diaphragm of a speaklet controlled by the control signal S is shown together with the velocity v and the acceleration a of the diaphragm at the center thereof. As can clearly be seen in FIG. 7, the acceleration a of the center of the diaphragm has, similar to the acceleration shown in FIG. 5, local maxima and local minima. Contrary to the acceleration shown in FIG. 5, the magnitude of the global maximum $a_{max}$ with respect to an initial value $a_{ini}$ thereof is significantly larger than the magnitude of the global minimum $a_{min}$ with respect to the initial value $a_{ini}$ thereof. Therefore, the effect of mutual extinction of sound pulses generated by different speaklets of a microelectromechanical sound transducer is reduced as compared to sound pulses generated by speaklets controlled by the control signal shown in FIG. 2. In this way, sound pulses with a higher net acoustic pressure of a predetermined sign can be generated as compared to speaklets controlled by a control pulse CS depicted in FIG. 2.

In an exemplary embodiment, the initial value $S_{ini}$ and/or the end value $S_{end}$ of the control signal S may be equal, e.g. zero. In this way, a smooth excitation of a diaphragm 108-1, 108-2, . . . , 108-M of a speaklet 102-1, 102-2, . . . , 102-M can be ensured enabling an accurate digital reconstruction of sound. In addition, the control signal S may have a vanishing first and second time derivative at its start position or timing to and/or at its end position or timing $T_{dig}$.

As shown in FIG. 7, the local maximum $S_{max}$ of the control signal S is larger than an end value Send of the control signal S and the local minimum $S_{min}$ of the control signal S is smaller than the end value $S_{end}$ of the control signal S. In this way, the diaphragm 108-1, 108-2, . . . , 108-M of a speaklet 102-1, 102-2, . . . , 102-M may be oscillated around a neutral position thereof enabling a substantially linear deflection of the individual diaphragms 108-1, 108-2, . . . , 108-M which in turn enables an accurate digital reconstruction of sound.

In an exemplary embodiment, the local maximum $S_{max}$ is a global maximum of the control signal S and/or the local minimum $S_{min}$ is a global minimum of the control signal S. In this way, a control signal S with only two local extrema can be provided which in turn contributes to a reduction of harmonic distortions, since then a diaphragm controlled by such a control signal S changes its direction only twice during the digital time $T_{dig}$.

As shown in FIG. 7, the control signal S may include: a first falling edge FE1 between the initial value Sini of the control signal S and the global minimum $S_{min}$ of the control signal S, a rising edge RE between the global minimum $S_{min}$ of the control signal S and the global maximum $S_{max}$ of the control signal S, and a second falling edge FE2 between the global maximum $S_{max}$ of the control signal S and the end value $S_{end}$ of the control signal S.

The first falling edge FE1 of the control signal S may be monotonically falling or even strictly monotonically falling, as shown in FIG. 7. The second falling edge FE2 of the control signal S may also be monotonically falling or even strictly monotonically falling, as indicated in FIG. 7. The rising edge RE of the control signal S may be monotonically rising, or even strictly monotonically rising, as shown in FIG. 7. A control signal of this kind has only two local extrema, i.e. the global maximum $S_{max}$ and the global minimum $S_{min}$, which, as mentioned above, may contribute to a reduction of harmonic distortions.

As also shown in FIG. 7, the difference between the initial value $S_{ini}$ and the global minimum $S_{min}$ is larger than the difference between the global maximum $S_{max}$ and the initial value $S_{ini}$. In an exemplary embodiment, the difference between the initial value $S_{ini}$ and the global minimum $S_{min}$ may be more than twice as large, optionally more than five times as large, further optionally more than ten times as large, as the difference between the global maximum $S_{max}$ of the control signal S and the initial value $S_{ini}$ thereof. Additionally or alternatively, the difference between the timing $t_{Smin}$ of the global minimum $S_{min}$ and the start timing to of the control signal S may be smaller than the difference between the timing $t_{Smax}$ of the global maximum $S_{max}$ and the timing $t_{Smin}$ of the global minimum $S_{min}$. Herewith, an imbalance between positive and negative acoustic pressure amplitudes can be efficiently generated.

In an exemplary embodiment, a duration $T_{dig}$* of the control signal S during which the acceleration a is positive may be less than $T_{dig}/5$, optionally less than $T_{dig}/4$, further optionally less than $T_{dig}/3$.

Figure 8:
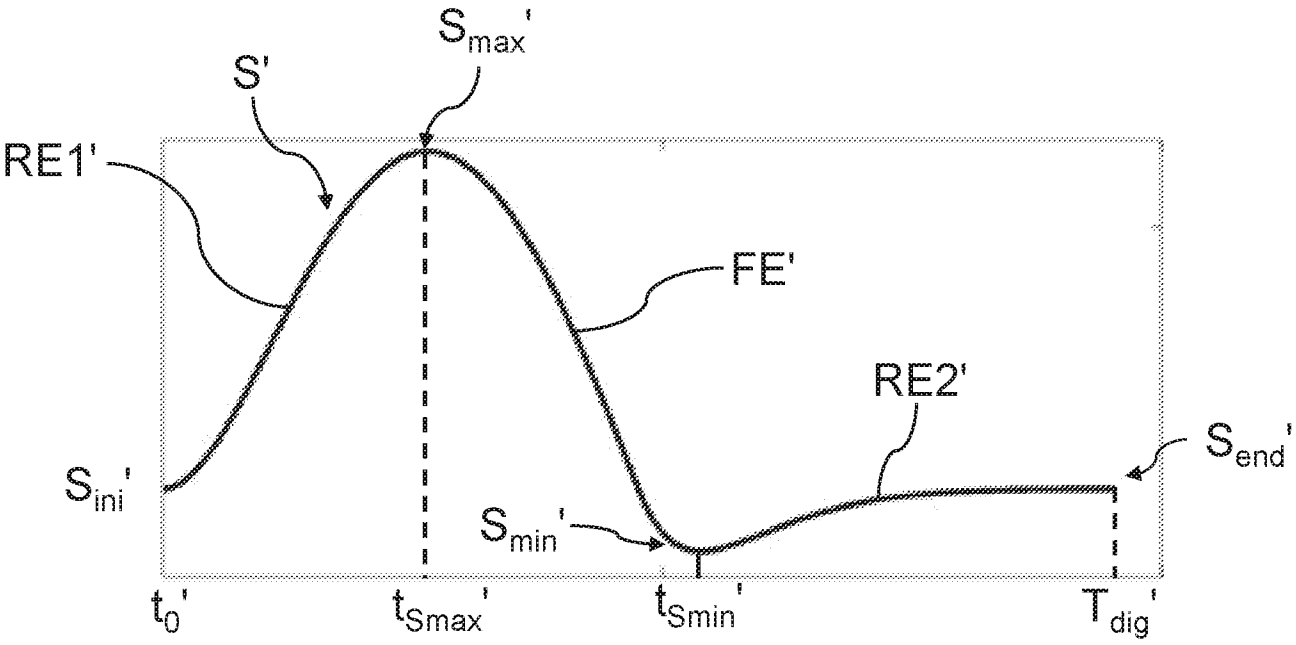
FIG. 8 shows a modified control signal according to the present disclosure.

An alternative implementation of a control signal according to the present disclosure is shown in FIG. 8. The control signal S' shown in FIG. 8 can be obtained from a control signal S shown in FIG. 7 by inversion. The control signals S and S' can be, hence, used to generate positive and negative pressure pulses, respectively, by the speaklets of a microelectromechanical loudspeaker.

As shown in FIG. 8, the control signal S' has a first rising edge RE1' between an initial value $S_{ini}$' of the control signal S' and a global maximum $S_{max}$' of the control signal S', a falling edge FE' between the global maximum $S_{max}$' of the control signal S' and the global minimum $S_{min}$' of the control signal S', and a second rising edge RE2' between the global minimum $S_{min}$' of the control signal S' and an end value $S_{end}$' of the control signal S' corresponding to the digital time $T_{dig}$'.

The first rising edge RE1' of the control signal S' may be monotonically rising, or even strictly monotonically rising, as shown in FIG. 8. The second rising edge RE2' of the control signal S' may be monotonically rising, or even strictly monotonically rising, as shown in FIG. 8. The falling edge FE' of the control signal S' may be monotonically falling, or even strictly monotonically falling, as indicated in FIG. 8.

As also shown in FIG. 8, the difference between the initial value $S_{ini}$' and the global minimum $S_{min}$' may be smaller than the difference between the global maximum $S_{max}$' and the initial value $S_{ini}$'. Additionally or alternatively, the difference between the timing $t_{Smax}$' of the global maximum $S_{max}$' and the start timing t0' of the control signal S' may be smaller than the difference between the timing $t_{Smin}$' of the global minimum $S_{min}$' and the timing $t_{Smax}$' of the global maximum $S_{max}$'. Herewith, an imbalance between positive and negative acoustic pressure amplitudes can be efficiently generated.

In addition, the initial value $S_{ini}$' and the end value $S_{end}$' of the control signal S' may be equal, e.g. zero. In this way, as mentioned above, a diaphragm may be smoothly deflected.

In an exemplary embodiment, a duration $T_{dig}$* of the control signal S' during which the acceleration a is negative may be less than $T_{dig}/5$, optionally less than $T_{dig}/4$, further optionally less than $T_{dig}/3$.

Figure 9:
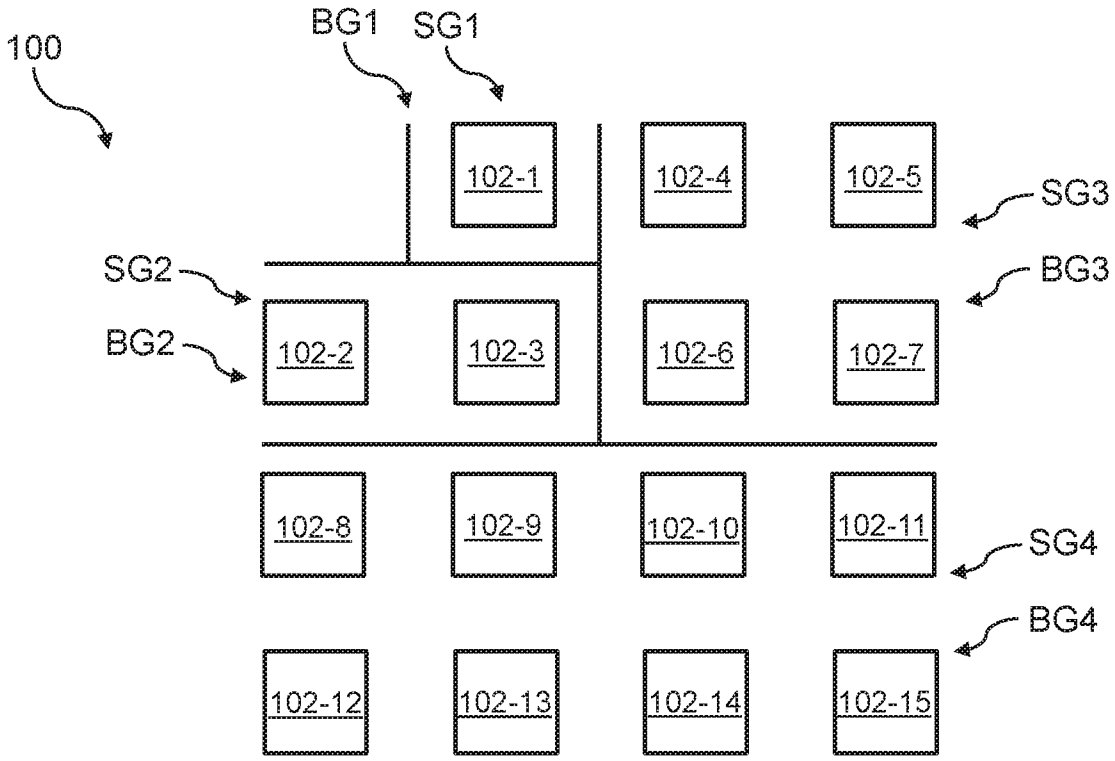
FIG. 9 is a schematic view of a microelectromechanical loudspeaker including a plurality of speaklets grouped into a plurality of bit groups.

As shown in FIG. 9, the elementary loudspeakers (speaklets) 102-1, 102-2, . . . , 102-M of the loudspeaker 100 discussed above may be grouped into a plurality of elementary-loudspeaker groups (speaklet groups) SG1-SG4. The speaklets assigned to mutually different elementary-loudspeaker groups SG1-SG4 are separated from each other by respective vertical or horizontal lines shown in FIG. 9. The controller 104 may be configured to assign a predetermined time frame, e.g., with a duration of the previously discussed digital time $T_{dig}$, to a predetermined speaklet group SG1-SG4, and to simultaneously supply control signals S, S' to the drive units 106-1, 106-2, . . . , 106-M of the elementary loudspeakers 102-1, 102-2, . . . , 102-M of the predetermined elementary-loudspeaker group SG1-SG4 during the predetermined time frame $T_{dig}$.

In an exemplary embodiment, the digital time $T_{dig}$ may be equal to or larger than 20 kHz, optionally equal to or larger than 40 kHz.

In an exemplary embodiment, the speaklets 102-1, 102-2, . . . , 102-M associated with the respective speaklet groups SG1-SG4 can be controlled by the controller 104 depending on the amplitude of the acoustic wave that is to be digitally reconstructed. By way of example, the controller 104 may be configured to supply control signals S, S' shown in FIGS. 7 and 8, respectively, to the speaklets of only one speaklet group SG1-SG4 during a predetermined time frame $T_{dig}$, e.g., when an acoustic wave with a small amplitude is to be digitally reconstructed. At higher acoustic-wave amplitudes that are to be digitally reconstructed, the speaklets of other speaklet groups SG1-SG4 may be controlled to also individually generate sound.

Figure 17A:
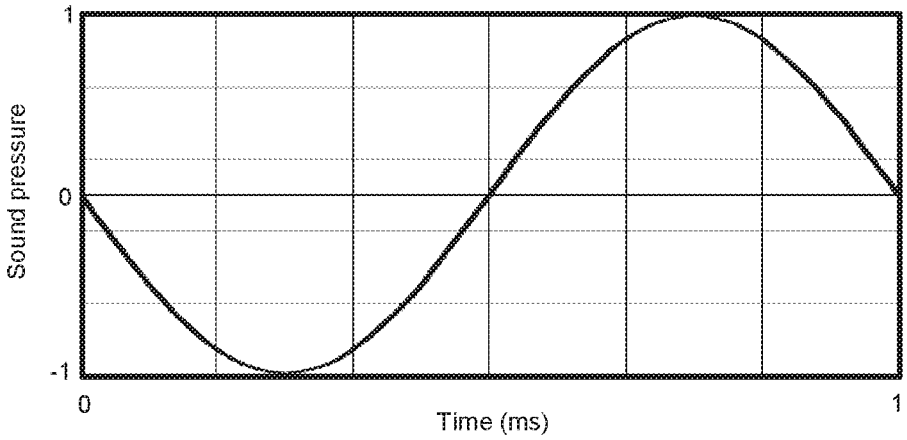
FIG. 17A shows an exemplary acoustic wave with a frequency of 1 kHz to be digitally reconstructed.
Figure 17B:
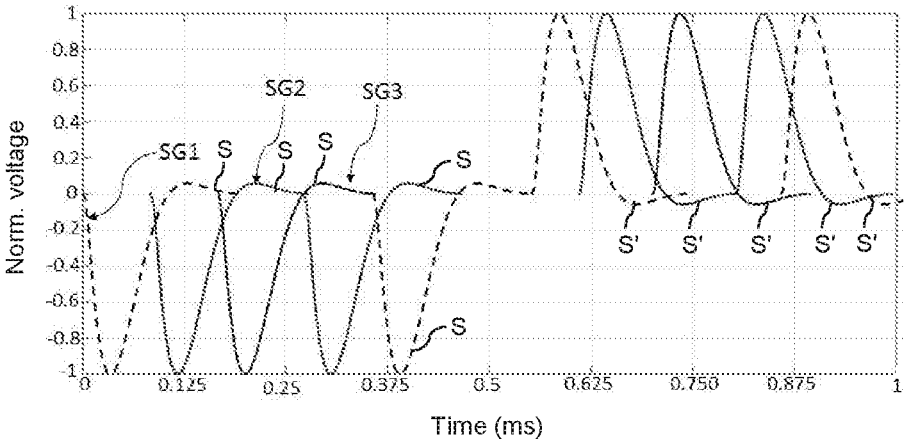
FIG. 17B shows an exemplary scheme of digitally reconstructing the acoustic wave shown in FIG. 17A.

An exemplary digital sound reconstruction scheme for digitally reconstructing a sinusoidal acoustic wave with a frequency of 1 kHz shown in FIG. 17A is exemplarily shown in FIG. 17B on the basis of an exemplary loudspeaker including three speaklet groups, e.g. the speaklet groups SG1 to SG3 shown in FIG. 9. As shown in FIG. 17B, control signals S, S' are supplied to the speaklets of different speaklet groups SG1-SG3 depending on the magnitude of sound pressure that is to be reconstructed. More specifically, as shown in FIG. 17B at low positive and negative sound pressures, control signals are supplied only to the first speaklet group SG1, while intermediate sound pressures are generated by means of the second speaklet group SG2 and high sound pressures by means of the third speaklet group SG3. As shown in FIG. 17B, the speaklets of a speaklet group are repeatedly used to reconstruct an acoustic wave.

In an exemplary embodiment, the controller 104 may be configured to assign to two mutually different speaklet groups SG1-SG4 respective time frames $T_{dig}$ that mutually overlap, meaning that the controller 104 supplies control signals S, S' during the overlapping time period of the respective time frames to the speaklets of both speaklet groups SG1-SG4.

As indicated in FIG. 9, the plurality of speaklet groups SG1-SG4 may include or may consist of a natural number N of bit groups BG1, . . . , BGN with pairwisely different numbers of speaklets. The number of speaklets of an n-th bit group may be $2^{n-1}$, optionally an integer multiple of $2^{n-1}$. Here n is a natural number ranging between 1 and N.

In the exemplary loudspeaker shown in FIG. 9, four bit groups BG1 to BG4 are provided. The first bit group BG1 includes a single ($2^{1-1}=2^0$) speaklet 102-1. The second bit group BG2 includes 2($=2^{2-1}$) speaklets 102-2, 102-3. The third bit group BG3 includes 4($=2^{3-1}$) speaklets 102-4 to 102-7. The fourth bit group BG4 includes 8($=2^{4-1}$) speaklets 102-8 to 102-15.

The number of bit groups is of course not limited to four, but may be varied depending on the specific application. In an exemplary embodiment, the loudspeaker 100 may include only the first to third bit groups BG1 to BG3 including a total of 7 speaklets 102-1 to 102-7.

The grouping of the speaklets 102-1 to 102-15 into bit groups defined above provides a simple way of digital reconstruction of sound digitally encoded on data storage devices without the need of providing complex processing devices for the conversion of different data formats.

In an exemplary embodiment, the controller 104 may be configured to assign to a plurality of the bit groups BG1 to BG4 or to all bit groups BG1 to BG4 respective time frames $T_{dig}$ that are mutually non-overlapping.

Figure 10A:
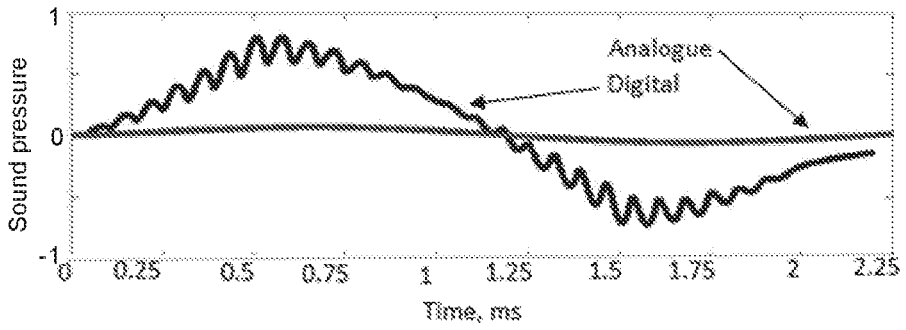
FIG. 10A shows a digitally reconstructed acoustic wave.

The result of a digital reconstruction of an acoustic wave by a loudspeaker including a controller configured to assign mutually non-overlapping time frames to individual bit groups is shown in FIG. 10A. In FIG. 10A, the sound pressure generated by a microelectromechanical loudspeaker 100 including three bit groups (labelled "Digital" in FIG. 10A) is shown together with a comparative example (labelled "Analogue" in FIG. 10B) in which all speaklets are driven with a harmonic signal having the same amplitude as the maximum value of the control signal. As can clearly be seen in this figure, a higher sound pressure can be generated by controlling the speaklets 102-1 to 102-7 by a control signal S, S' described above. Here, the audio frequency $f_{audio}$ is 500 Hz and the carrier frequency is 54 kHz.

The quality of digital reconstruction can be characterized by means of the total harmonic distortion THD defined by the following expression:

$$THD=\Sigma_{n>1}A_n/A_1. \quad (3)$$

Figure 10B:
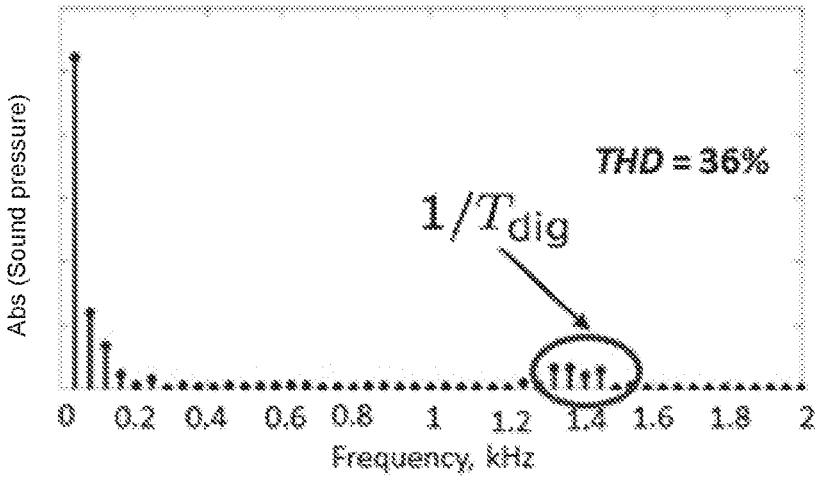
FIG. 10B shows the magnitudes of the frequency components of the digitally reconstructed acoustic wave shown in FIG. 10A.

In expression (3), $A_n$ denotes the magnitudes of the frequency components of the digitally reconstructed acoustic wave shown in FIG. 10A. $A_1$ denotes the amplitude of the frequency component with frequency $f_{audio}$. The magnitudes of the frequency components $A_n$ of the acoustic wave shown in FIG. 10A are depicted in FIG. 10B. As shown in FIG. 10B, the most significant distortions are present at frequencies of the order of the inverse of the digital time $T_{dig}$, i.e. at frequencies of the order of $1/T_{dig}$. For the digitally reconstructed sound wave shown in FIG. 10A, a THD of about 36% has been achieved with an exemplary loudspeaker. The lower the total harmonic distortion, the smoother is the digitally reconstructed acoustic wave.

Another measure of the quality of the digitally reconstructed sound is the ratio R of the amplitude A1 defined above to the amplitude $A_a$ of the comparative example labelled "Analogue" in FIG. 10A, i.e. $R=A_1A_a$. In the example shown in FIGS. 10A and 10B, a ratio R of about 11.2 has been obtained.

The quality of digital sound reconstruction can be improved by providing a higher number of speaklets that can be controlled simultaneously, e.g. by a higher number of bit groups. In the above example described with reference to FIGS. 10A and 10B, the total harmonic distortion could be reduced to about 29% and the ratio R could be increased to about 23.1 by increasing the number of bit groups from three to four in an exemplary loudspeaker.

In the following description, the above-described configuration will be referred to as "basic configuration".

In the above-described basic configuration, the time frames assigned by the controller 104 to the individual bit groups BG1-BGN are mutually non-overlapping. In an alternative configuration, the controller 104 may be configured to assign to the individual bit groups BG1-BGN time frames that mutually overlap. More specifically, the controller 104 may be configured to assign an n-th time frame to an n-th bit group BGn that overlaps with an (n−1)-th time frame assigned to an (n−1)-th bit group BGn−1 by the controller 104 and/or with an (n+1)-th time frame assigned to an (n+1)-th bit group BGn+1 by the controller 104.

This operational principle of the microelectromechanical loudspeaker 100 shown in FIG. 9 will be described in the following on the basis of FIG. 11.

Figure 11:
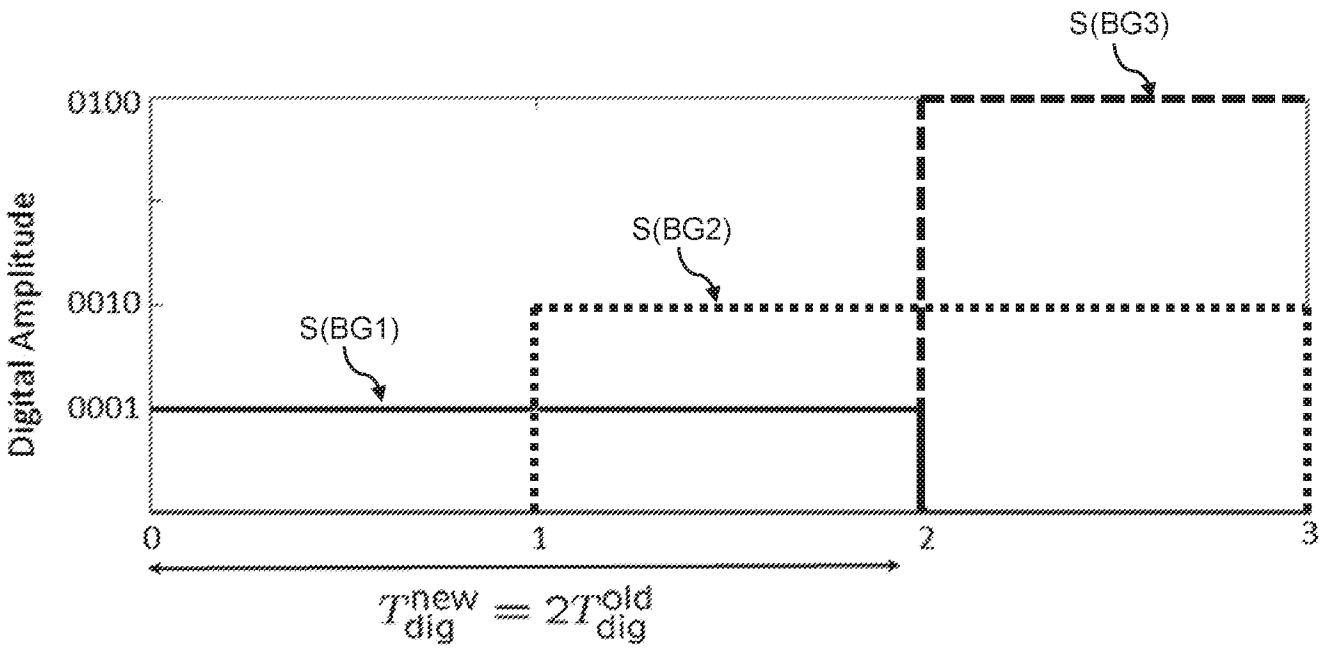
FIG. 11 is a diagram illustrating a modified operational principle of the speaklets shown in FIG. 9.

In FIG. 11 a plurality of rectangular signals is depicted over time. The rectangular signal S(BG1) is a simplified representation of a control signal S or S' shown in FIGS. 7 and 8 applied to the speaklet 102-1 of the first bit group BG1 during a time frame $T_{dig}^{new}$ assigned by the controller 104 to the first group BG1. The time frame $T_{dig}^{new}$ may be twice as long as the above discussed time frame $T_{dig}$, i.e. $T_{dig}^{new}=2T_{dig}$.

The rectangular signal S(BG2) is a simplified representation of a control signal S or S' shown in FIGS. 7 and 8 applied to the speaklets 102-2 and 102-3 of the second bit group BG2 during a time frame $T_{dig}^{new}$ assigned by the controller 104 to the second group BG2.

The rectangular signal S(BG3) is a simplified representation of a control signal S or S' shown in FIGS. 7 and 8 applied to the speaklets 102-4 and 102-7 of the third bit group BG3 during a time frame $T_{dig}^{new}$ assigned by the controller 104 to the third bit group BG3.

Due to the mutual overlap of the time frames assigned to the different bit groups, the amplitude of sound with an undesired polarity may be reduced. A mutual overlap of two individual time frames may be achieved by advancing a time frame to be overlapped with a preceding time frame by $T_{dig}^{new}/2$, i.e. by $T_{dig}$.

Figure 12A:
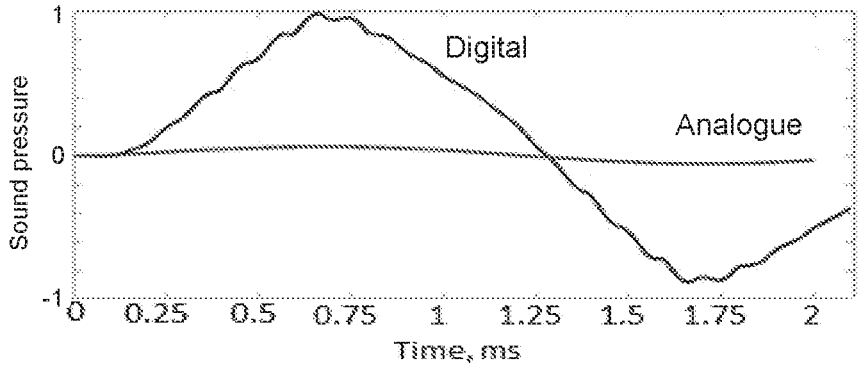
FIG. 12A shows an acoustic wave digitally reconstructed according to the modified operational principle illustrated in FIG. 11.
Figure 12B:
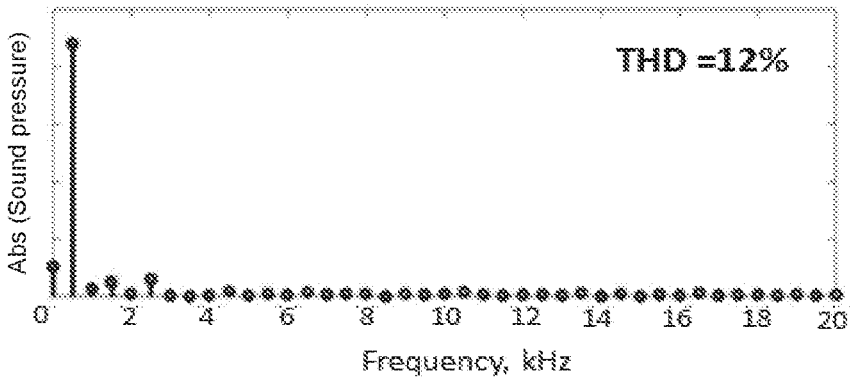
FIG. 12B shows the magnitudes of the frequency components of the digitally reconstructed acoustic wave shown in FIG. 12A.

The results obtained by means of this configuration are shown in FIGS. 12A and 12B for an exemplary microelectromechanical loudspeaker 100 including four bit groups BG1-BG4. In FIG. 12A, a digitally reconstructed sound wave labelled "Digital" is shown together with a sound wave labelled "Analogue" generated by the above-described analogue method. In FIG. 12B, the magnitudes of the frequency components of the digitally reconstructed sound wave depicted in FIG. 12A are shown.

The configuration described above with respect to FIGS. 11 as well as FIGS. 12A and 12B will be referred to as "overlapping-frames configuration" in the subsequent description. By means of the overlapping-frames configuration, a ratio R of about 8.5 and a THD of about 12% could be achieved with an exemplary loudspeaker, meaning that both the ratio R and the THD could be decreased as compared to the above-described basic configuration.

Figure 13:
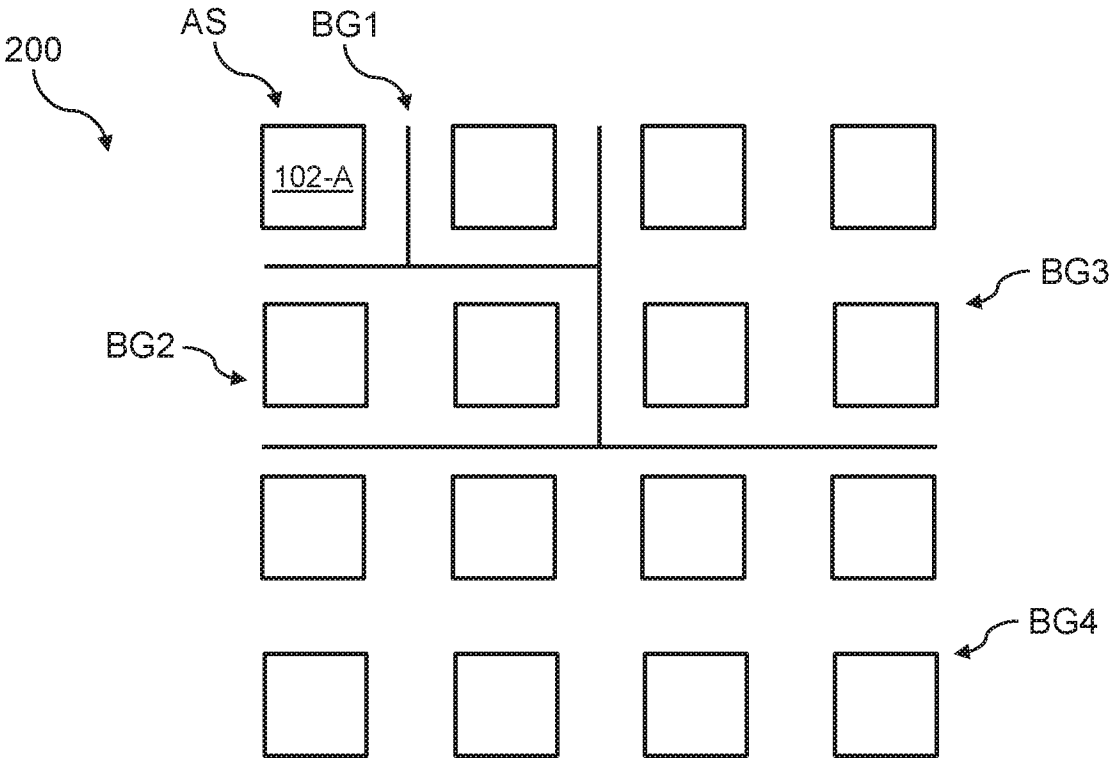
FIG. 13 is a schematic view of a modified microelectromechanical loudspeaker including a plurality of speaklets grouped into a plurality of bit groups, and an additional speaklet group.

A modified microelectrical loudspeaker 200 will be described in the following with respect to FIG. 13. As shown in FIG. 13, the modified loudspeaker 200 may include a plurality of bit groups such as three or four bit groups BG1 to BG4 similar to the microelectromechanical loudspeaker 100 described above. Different from the loudspeaker 100 shown in FIG. 9, the loudspeaker 200 shown in FIG. 13 includes an additional elementary-loudspeaker group (speaklet group) AS. In the following description, the configuration shown in FIG. 13 will be referred to as "additional-speaklet configuration".

The additional speaklet group AS is different from the bit groups BG1 to BG4 and may include a single additional speaklet 102-A, as indicated in FIG. 13, or a plurality of additional speaklets.

The controller 104 may be configured to assign to the additional speaklet group AS an additional time frame $T_{dig}^{AS}$ that overlaps with one or more time frames $T_{dig}$ assigned to one or more of the bit groups BG1 to BG4.

Figure 14:
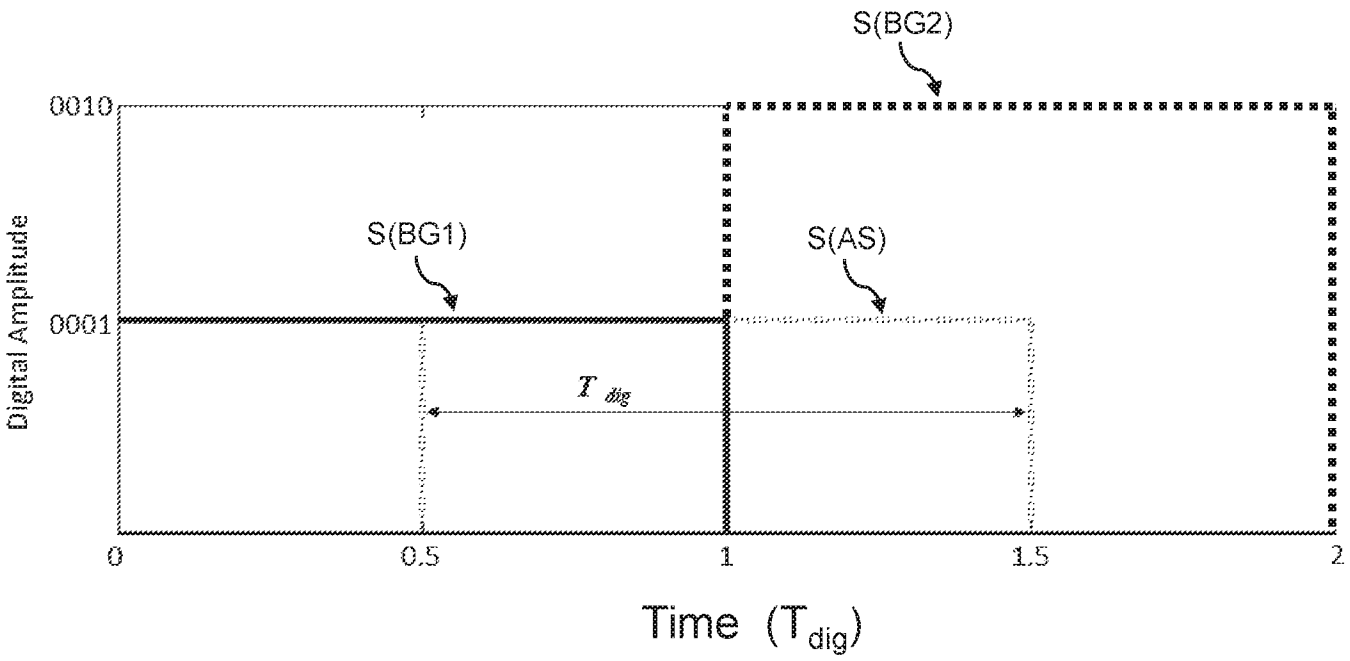
FIG. 14 is a diagram illustrating a further operational principle of operating the loudspeaker shown in FIG. 13.

The operational principle of the microelectromechanical loudspeaker 200 shown in FIG. 13 is illustrated in FIG. 14. In FIG. 14 a plurality of rectangular signals is depicted over time in units of the digital time $T_{dig}$. The rectangular signal S(BG1) is a simplified representation of a control signal S or S' shown in FIGS. 7 and 8, respectively, applied to the speaklet 102-1 of the first bit group BG1 during a time frame $T_{dig}$ assigned by the controller 104 to the first group BG1.

The rectangular signal S(BG2) is a simplified representation of a control signal S or S' shown in FIGS. 7 and 8, respectively, applied to the speaklets 102-2 and 102-3 of the second bit group BG2 during a time frame $T_{dig}^{AS}$ assigned by the controller 104 to the second group BG2.

The rectangular signal S(AS) is a simplified representation of a control signal S or S' shown in FIGS. 7 and 8, respectively, applied to the additional speaklet 102-A of the additional speaklet group AS during a time frame $T_{dig}^{AS}$ assigned by the controller 104 to the additional speaklet group AS.

As can clearly be seen in FIG. 14, the signals S(BG1) and S(BG2) do not mutually overlap, but each of these signals overlaps with the signal S(AS) during half of the respective time frames $T_{dig}$ respectively assigned to the first and second bit groups BG1 and BG2 by the controller 104. Consequently, the duration of the time frame assigned to the additional speaklet group AS may be identical to the duration of the time frame assigned to the bit groups BG1, BG2.

By means of the additional speaklet group AS a higher sound pressure and a lower total harmonic distortion can be achieved as compared to the basic configuration, since, due to the mutual overlap of the respective time frames, the speaklet 102-A of the additional speaklet group AS generates sound with positive pressure when the speaklets of the bit groups generate sound with negative pressure and vice versa.

The overall performance of a loudspeaker including an additional speaklet group as described above additionally depends on the number of bit groups. With an exemplary loudspeaker including three bit groups and an additional speaklet group, a ratio R of about 13.4 and a THD of about 23% could be achieved. With an exemplary loudspeaker including four bit groups and an additional speaklet group, a ratio R of about 25.1 and a THD of about 21% could be achieved. Consequently, as compared to the above-described basic configuration, both a higher acoustic pressure expressed by the ratio R as well as a lower total harmonic distortion THD can be achieved by the additional speaklet group.

Figure 15A:
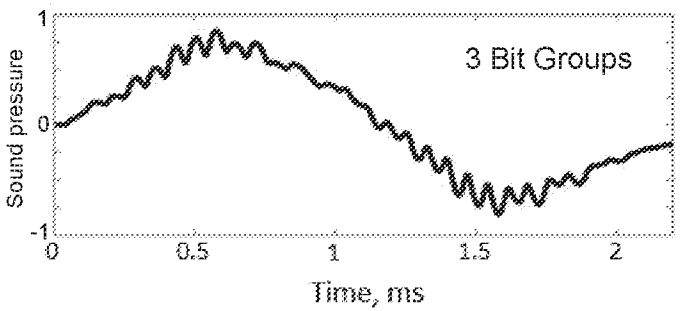
FIG. 15A shows an acoustic wave digitally reconstructed by a loudspeaker according to FIG. 13 including three bit groups.
Figure 15B:
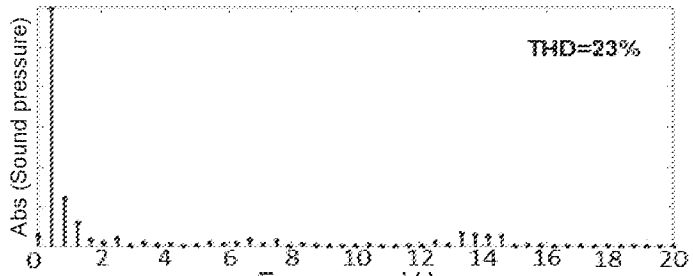
FIG. 15B shows the magnitudes of the frequency components of the digitally reconstructed acoustic wave shown in FIG. 15A.
Figure 15C:
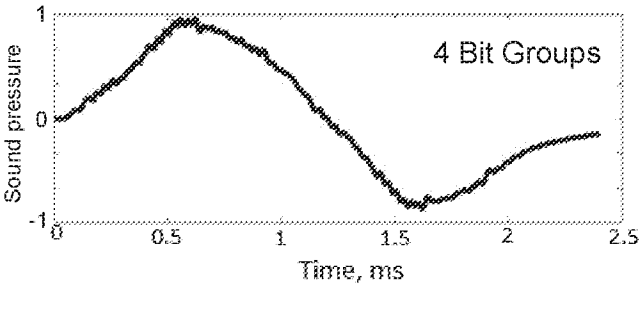
FIG. 15C shows an acoustic wave digitally reconstructed by a loudspeaker according to FIG. 13 including four bit groups.
Figure 15D:
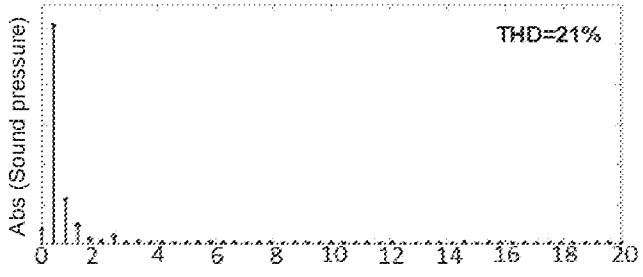
FIG. 15D shows the magnitudes of the frequency components of the digitally reconstructed acoustic wave shown in FIG. 15C.

FIGS. 15A to 15D show the results obtained by the loudspeaker 200 shown in FIG. 13. The diagram of FIG. 15A shows the digitally reconstructed sound wave and the diagram of FIG. 15B the magnitudes of the frequency components thereof for a loudspeaker 200 including three bit groups and an additional speaklet group. The diagram of FIG. 15C shows the digitally reconstructed sound wave and the diagram of FIG. 15D the magnitudes of the frequency components thereof for a loudspeaker including four bit groups and an additional speaklet group.

The ratio R obtained with an exemplary loudspeaker 200 including three bit groups is about 13.4 and with an exemplary loudspeaker 200 including four bit groups is about 25.1.The THD obtained with an exemplary loudspeaker 200 including three bit groups is about 23% and with an exemplary loudspeaker 200 including four bit groups is about 21%.

The results of the above-discussed configurations are summarized for exemplary loudspeakers in the table of FIG. 16. As can clearly be seen in this table, the highest ratio R was obtained by an exemplary loudspeaker implementing the additional-speaklet configuration and including four bit groups. The lowest THD was obtained by an exemplary loudspeaker implementing the overlapping-frames configuration and including four bit groups.

In the following, various examples according to the present disclosure will be described.

Example 1 is a microelectromechanical loudspeaker. The loudspeaker may include: a plurality of elementary loudspeakers each comprising a drive unit and a diaphragm deflectable by the drive unit, and a controller configured to respectively supply control signals to the drive units. The drive units may be respectively configured to deflect the corresponding diaphragms according to the respective control signals supplied by the controller to generate acoustic waves. A control signal supplied to at least one drive unit, optionally control signals supplied to a plurality of drive units, further optionally the control signals supplied to each drive unit, may have at least one local extremum, and a global extremum of a curvature of the control signal with a highest absolute value of the curvature may be located at a position of the control signal preceding a position of the at least one local extremum of the control signal.

In Example 2, the subject matter of Example 1 can optionally further include that the control signal has a plurality of local extrema.

In Example 3, the subject matter of Example 2 can optionally further include that the position of the global extremum of the curvature of the control signal with the highest absolute value precedes the positions of each of the plurality of local extrema of the control signal.

In Example 4, the subject matter of any one of Examples 2 or 3 can optionally further include that the control signal has a local minimum smaller than an initial value and/or an end value thereof and a local maximum larger than the initial value and/or the end value thereof.

In Example 5, the subject matter of Example 4 can optionally further include that the local maximum is a global maximum of the control signal and/or the local minimum is a global minimum of the control signal.

In Example 6, the subject matter of Example 5 can optionally further include that the position of the global maximum of the control signal precedes the position of the global minimum of the control signal, and the control signal includes: a first rising edge between the initial value of the control signal and the global maximum of the control signal, a falling edge between the global maximum of the control signal and the global minimum of the control signal, and a second rising edge between the global minimum of the control signal and the end value of the control signal.

In Example 7, the subject matter of Example 6 can optionally further include that the first rising edge of the control signal is monotonically rising, optionally strictly monotonically rising, and/or the second rising edge of the control signal is monotonically rising, optionally strictly monotonically rising, and/or the falling edge of the control signal is monotonically falling, optionally strictly monotonically falling.

In Example 8, the subject matter of Example 5 can optionally further include that the position of the global minimum of the control signal precedes the position of the global maximum of the control signal, and the control signal comprises: a first falling edge between the initial value of the control signal and the global minimum of the control signal, a rising edge between the global minimum of the control signal and the global maximum of the control signal, and a second falling edge between the global maximum of the control signal and the end value of the control signal.

In Example 9, the subject matter of Example 8 can optionally further include that the first falling edge of the control signal is monotonically falling, optionally strictly monotonically falling, and/or the second falling edge of the control signal is monotonically falling, optionally strictly monotonically falling, and/or the rising edge of the control signal is monotonically rising, optionally strictly monotonically rising.

In Example 10, the subject matter of any one of Examples 5 to 9 can optionally further include that a difference between the initial value and the global minimum of the control signal is different from a difference between the global maximum and the initial value of the control signal. Optionally the difference between the initial value and the global minimum of the control signal may be smaller than the difference between the global maximum and the initial value of the control signal or the difference between the initial value and the global minimum of the control signal may be larger than the difference between the global maximum and the initial value of the control signal.

In Example 11, the subject matter of any one of Examples 1 to 10 can optionally further include that the elementary loudspeakers are grouped into a plurality of elementary-loudspeaker groups. The controller may be configured to assign a predetermined time frame to a predetermined elementary-loudspeaker group and to simultaneously supply control signals to the drive units of the elementary loudspeakers of the predetermined elementary-loudspeaker group during the predetermined time frame.

In Example 12, the subject matter of Example 11 can optionally further include that the controller is configured to supply control signals only to the drive units of the elementary loudspeakers of the predetermined elementary-loudspeaker group during the predetermined time frame.

In Example 13, the subject matter of Example 11 can optionally further include that the controller is configured to assign to two mutually different elementary-loudspeaker groups respective time frames that mutually overlap.

In Example 14, the subject matter of any one of Examples 11 to 13 can optionally further include that the plurality of elementary-loudspeaker groups includes N bit groups with pairwisely different numbers of elementary loudspeakers with N being a natural number. The number of elementary loudspeakers of an n-th bit group may be $2^{n-1}$, optionally an integer multiple of $2^{n-1}$, with n being a natural number ranging between 1 and N.

In Example 15, the subject matter of Examples 12 and 14 can optionally further include that the controller is configured to assign to a plurality of the bit groups or to all bit groups respective time frames that are mutually non-overlapping.

In Example 16, the subject matter of Examples 13 and 14 can optionally further include that the controller is configured to assign an n-th time frame to an n-th bit group. The n-th time frame may overlap with an (n−1)-th time frame assigned to an (n−1)-th bit group by the controller and/or with an (n+1)-th time frame assigned to an (n+1)-th bit group by the controller.

In Example 17, the subject matter of any one of claims 14 to 16 can optionally further include that the plurality of elementary-loudspeaker groups further includes an additional elementary-loudspeaker group different from the N bit groups. The controller may be configured to assign to the additional elementary-loudspeaker group an additional time frame that overlaps with an n-th time frame assigned to an n-th bit group.

In Example 18, the subject matter of Example 17 can optionally further include that the additional time frame overlaps with an (n+1)-th time frame assigned to an (n+1)-th bit group and/or an (n−1)-th time frame assigned to an (n−1)-th bit group.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A microelectromechanical loudspeaker, comprising:

a plurality of elementary loudspeakers each comprising a drive unit and a diaphragm deflectable by the drive unit; and a controller configured to respectively supply control signals to the drive units, wherein the drive units are respectively configured to deflect corresponding diaphragms according to the respective control signals supplied by the controller to generate acoustic waves, wherein a control signal supplied to at least one control unit has at least one local extremum and wherein a global extremum of a curvature of the control signal with a highest absolute value of the curvature is located at a position of the control signal preceding a position of the at least one local extremum of the control signal.

2. The microelectromechanical loudspeaker of claim 1, wherein the control signal has a plurality of local extrema.

3. The microelectromechanical loudspeaker of claim 2, wherein the position of the global extremum of the curvature of the control signal with the highest absolute value precedes the positions of each of the plurality of local extrema of the control signal.

4. The microelectromechanical loudspeaker of claim 2, wherein the control signal has a local minimum smaller than an initial value and/or an end value thereof and a local maximum larger than the initial value and/or the end value thereof.

5. The microelectromechanical loudspeaker of claim 4, wherein the local maximum is a global maximum of the control signal and/or the local minimum is a global minimum of the control signal.

6. The microelectromechanical loudspeaker of claim 5, wherein the position of the global maximum of the control signal precedes the position of the global minimum of the control signal, and the control signal comprises:

a first rising edge between the initial value of the control signal and the global maximum of the control signal;

a falling edge between the global maximum of the control signal and the global minimum of the control signal; and a second rising edge between the global minimum of the control signal and the end value of the control signal.

7. The microelectromechanical loudspeaker of claim 6, wherein the first rising edge of the control signal rises monotonically, or the second rising edge of the control signal rises monotonically, or the falling edge of the control signal falls monotonically.

8. The microelectromechanical loudspeaker of claim 7, wherein:

the first rising edge of the control signal rises strictly monotonically;

the second rising edge of the control signal rises strictly monotonically; or the falling edge of the control signal falls strictly monotonically.

9. The microelectromechanical loudspeaker of claim 5, wherein the position of the global minimum of the control signal precedes the position of the global maximum of the control signal, and the control signal comprises:

a first falling edge between the initial value of the control signal and the global minimum of the control signal;

a rising edge between the global minimum of the control signal and the global maximum of the control signal; and a second falling edge between the global maximum of the control signal and the end value of the control signal.

10. The microelectromechanical loudspeaker of claim 9, wherein the first falling edge of the control signal falls monotonically, or the second falling edge of the control signal falls monotonically, or the rising edge of the control signal rises monotonically.

11. The microelectromechanical loudspeaker of claim 10, wherein:

the first falling edge of the control signal falls strictly monotonically;

the second falling edge of the control signal falls strictly monotonically; or the rising edge of the control signal rises strictly monotonically.

12. The microelectromechanical loudspeaker of claim 5, wherein a difference between the initial value and the global minimum of the control signal is different from a difference between the global maximum and the initial value of the control signal.

13. The microelectromechanical loudspeaker of claim 12, wherein the difference between the initial value and the global minimum of the control signal is smaller than the difference between the global maximum and the initial value of the control signal, or the difference between the initial value and the global minimum of the control signal is larger than the difference between the global maximum and the initial value of the control signal.

14. The microelectromechanical loudspeaker of claim 1, wherein the elementary loudspeakers are grouped into a plurality of elementary-loudspeaker groups, and the controller is configured to assign a predetermined time frame to a predetermined elementary-loudspeaker group and to simultaneously supply control signals to the drive units of the elementary loudspeakers of the predetermined elementary-loudspeaker group during the predetermined time frame.

15. The microelectromechanical loudspeaker of claim 14, wherein the controller is configured to supply control signals only to the drive units of the elementary loudspeakers of the predetermined elementary-loudspeaker group during the predetermined time frame.

16. The microelectromechanical loudspeaker of claim 14, wherein the controller is configured to assign to two mutually different elementary-loudspeaker groups respective time frames that mutually overlap.

17. The microelectromechanical loudspeaker of claim 11, wherein the plurality of elementary-loudspeaker groups comprises N bit groups with pairwisely different numbers of elementary loudspeakers, wherein N is a natural number, and wherein the number of elementary loudspeakers of an n-th bit group is an integer multiple of $2^{n-1}$, wherein n is a natural number ranging between 1 and N.

18. The microelectromechanical loudspeaker of claim 17, wherein the controller is configured to assign to a plurality of the bit groups or to all bit groups respective time frames that are mutually non-overlapping.

19. The microelectromechanical loudspeaker of claim 17, wherein the controller is configured to assign an n-th time frame to an n-th bit group, wherein the n-th time frame overlaps with an (n−1)-th time frame assigned to an (n−1)-th bit group by the controller and/or with an (n+1)-th time frame assigned to an (n+1)-th bit group by the controller.

20. The microelectromechanical loudspeaker of claim 17, wherein the plurality of elementary-loudspeaker groups further comprises an additional elementary-loudspeaker group different from the N bit groups, and the controller is configured to assign to the additional elementary-loudspeaker group an additional time frame that overlaps with an n-th time frame assigned to an n-th bit group.

21. The microelectromechanical loudspeaker of claim 20, wherein the additional time frame overlaps with an (n+1)-th time frame assigned to an (n+1)-th bit group and/or an (n−1)-th time frame assigned to an (n−1)-th bit group.

* * * * *